United States Patent [19]

Davis

[11] 3,996,466

[45] Dec. 7, 1976

[54] TRANSFER CORONA DEVICE WITH ADJUSTABLE SHIELD BIAS

[75] Inventor: Thomas G. Davis, Pittsford, N.Y.

[73] Assignee: Xerox Corporation, Stamford, Conn.

[22] Filed: Feb. 26, 1975

[21] Appl. No.: 553,340

[52] U.S. Cl. ..... 250/325; 317/262 A

[51] Int. Cl.[2] ..... H01T 19/04

[58] Field of Search ..... 250/324, 325, 326; 317/262 A

[56] References Cited

UNITED STATES PATENTS

| | | | |
|---|---|---|---|
| 3,754,137 | 8/1973 | Kamogawa et al. | 250/326 |
| 3,830,589 | 8/1974 | Allen | 250/325 |

OTHER PUBLICATIONS

The O. G. Def. Pub. KAUKEINEN, Def. Pub. of Ser. No. 34,286 filed May 4, 1970, published in 890 O. G. 979, on Sept. 21, 1971, Def. Pub. No. T890,003,

*Primary Examiner*—Alfred E. Smith
*Assistant Examiner*—T. N. Grigsby

[57] ABSTRACT

A corona discharge arrangement for shifting the transfer point in a xerographic machine comprising an elongated wire and a shield having a plurality of conductive segments insulated from each other. A biasing arrangement is provided for changing the bias potentials on the various segments to effect a shift in the transfer point in response to preselected conditions. The transfer point may alternatively be maintained stationary by changes in the biasing potentials in response to changes in conditions which would otherwise result in a change in the transfer point.

10 Claims, 3 Drawing Figures

TRANSFER CORONA DEVICE WITH ADJUSTABLE SHIELD BIAS

BACKGROUND OF THE INVENTION

In application Ser. No. 553,339, filed concurrently with this application in the name of the same inventor and commonly assigned, there is disclosed a novel corona discharge device comprising an elongated wire electrode and a shield partially surrounding the electrode, the shield being formed of a plurality of conducting segments insulated from each other and biased to a plurality of different potentials to create an asymmetrical electric field. The result of such a corona arrangement is to unbalance with respect to the wire electrode the density of ions across the ion delivery opening of the corona device.

This application is directed to the incorporation of such a device into a xerographic process as a means of conveniently controlling the transfer point under a transfer corona device. More specifically, in one stage of the xerographic process, charged toner is moved or transferred from the surface of a photoconductor to the surface of a copy sheet by bringing the front side of the sheet into contact with the toner covered surface of the photoconductor while concurrently applying a suitable charge of proper polarity to the other or back side of the sheet. When a given area on the back side of the sheet reaches a critical charge or transfer level, toner on the surface of the photoconductor opposite said given area is transferred or moved into contact with the adjacent front surface of the copy sheet. With a given transfer corona device, any given area of the back surface of the sheet will reach the critical transfer charge level at a distance under the corona device which is a function of various factors including humidity conditions, copy paper characteristics. The location or position of the given area under the corona device at which this critical charge transfer level is reached may be referred to as the transfer point. Since additional paper processing steps follow the transfer station in a xerographic process, it is important that the transfer point and the transfer of toner be fully completed well prior to further processing of the sheet. Since the transfer point may vary due to the above noted conditions, it is desirable to have a means for controlling this point as a function of such conditions during the xerographic process.

OBJECTS AND SUMMARY

It is therefore an object of the invention to utilize a corona discharge device of the type disclosed in the aforementioned application Ser. No. 553,339 to adjust in a xerographic process the transfer point in the same direction or in an opposed direction to the movement of copy paper as a function of various conditions.

A further object is to provide a means for changing the symmetry of the charge deposited by a corona device in a xerographic process in accordance with preselected conditions.

These and other objects of the invention are accomplished by means of a corona discharge arrangement comprising an elongated wire electrode and a shield partially surrounding the electrode, the shield being formed of a plurality of conducting segments insulated from each other and biased to a plurality of different potentials to create an asymmetrical electric field across the cross-sectional area of the corona device which results in an asymmetrical density of charge traveling toward an adjacent surface. A control circuit is provided which responds to preselected conditions to alter the magnitude or distribution of potentials on the various segments of a transfer corona device to thereby move the transfer point in the direction of paper movement or in a direction opposed thereto in response to said conditions.

DESCRIPTION OF THE PREFERRED EMBODIMENT

The invention is directed to an arrangement for incorporation into one of the many electrophotographic processes commercially in use today which utilize as one step in the process the transfer of charged toner from one surface to another by means of a corona discharge device. For a general understanding of the process in which the invention may be incorporated, reference may be had to U.S. Pat. Nos. 3,496,352 and 3,275,837. Briefly, in a xerographic process, a xerographic plate comprising a layer of photoconductive insulating material on a conductive backing is given a uniform electric charge over its surface and is then exposed to an optical image of the information to be recorded. This exposure selectively discharges the plate areas in accordance with the radiation intensity which reaches them and thereby creates an electrostatic latent image on the surface of the photoconductor.

Development of the image is effected with developer material which may comprise, in general, a mixture of a suitable pigmented or dyed electroscopic powder or toner, and a granular carrier material, the latter functioning to carry the toner into contact with the photoconductor and to generate triboelectric charges on the toner. During the development step of the process, the toner powder is brought into contact with the plate and adheres to those portions of the plate having a polarity opposite to the polarity of the plate in a manner well known in the art. Thereafter, the developed image is transferred to a support material, which may be a cut sheet of paper, to which it is subsequently fixed by suitable fixing means to render it permanent. The transfer step is conventionally performed by means of a transfer corona device which deposits a charge on one side of the sheet while the other side is concurrently held in contact with the developed image on the photoconductor. The details of the above-noted process are generally known in the prior art.

Figure 1:
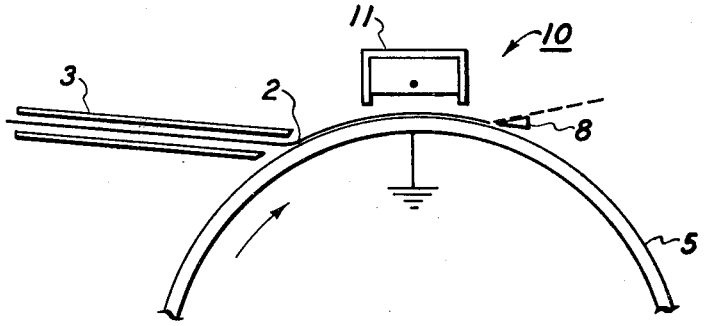
FIG. 1 is an illustrative drawing of the transfer step of a xerographic process.

Referring now to FIG. 1, there is shown schematically the image transfer station 10 of an automatic xerographic reproducing apparatus, at which, the xerographic powder image previously formed on the xerographic plate 5 is electrically transferred from the xerographic plate to a support surface, such as cut sheet paper 2.

As shown in FIG. 1, the image transfer station includes a sheet feeding arrangement 3 adapted to feed sheets of support material successively to a xerographic plate 5 in coordination with the presentation of the developed image on the plate surface at the transfer station 10.

Immediately subsequent to the image transfer station in a xerographic process, there is positioned a stripping apparatus or paper pick-off mechanism 8 for removing the sheets of support material from the drum surface. The stripping mechanism is shown, for ease of illustration, as a beveled member located in close proximity to the drum surface to lift or remove the paper from the drum. The stripping mechanism may also be of a type disclosed in U.S. Pat. No. 3,062,536 which includes a plurality of small diameter orifices supplied with pressurized air by a suitable pulsator. The pulsator is adopted to force jets of pressurized air into contact with the surface of the drum slightly in advance of the sheet of material to strip the leading edge of the sheet from the drum surface and to direct it onto an endless conveyor.

The xerographic plate 5, as is well known in the art, includes a photoconductive layer or light receiving surface on a conductive backing and may be formed in the shape of a drum. The plate or drum 5 is mounted to rotate in the direction indicated by the arrow to cause the drum surface to move pass the hereinbefore described processing station, including the transfer station 8.

The transfer of the xerographic powder image from the surface of the drum 5 to the sheets of support material 2 is effected by means of a corona charging device 11, constructed in accordance with the invention that is located at or immediately after the line of contact between the support material 2 and the rotating drum 5. In operation, the electrostatic field created by the corona charging device is effective to tack the support material electrostatically to the drum surface, whereby the support material of the sheet 2 moves synchronously with the drum while in contact therewith. Concurrently with the tacking action, the electrostatic field is effective to attract toner particles comprising the xerographic powder image from the drum surface and cause them to adhere electrostatically to the surface of the support material. This latter action of attracting toner particles from the surface of the photoconductive drum to the sheet material is the subject matter of this invention. As a background to understanding the invention, a brief discussion of the transfer step follows.

During the transfer step of a xerographic process, toner is held in image-wise configuration on the surface of the photoconductor. The front side of a copy sheet is brought into contact with the surface of the photoconductor to thereby move in synchronism therewith. Concurrently, the back side of the sheet is charged by being moved under a transfer corona device. As the sheet progresses farther under the transfer corona device, the charge on its back surface increases to and beyond the point at which toner on the surface of the photoconductor leaves and adheres or transfers into contact with the support sheet. The toner on any given area of the surface of the drum is transferred to the transfer sheet at a position under the transfer corona device at which the charge on the side of the sheet adjacent the given area reaches a critical or transfer level. Stated differently, when a given area on the back side of the sheet reaches the critical transfer level, toner on the surface of the drum opposite said given area is transferred or moved into contact with the adjacent front surface of the copy sheet.

With a given transfer corona device, any given area of the back surface of the sheet will reach the critical transfer charge level at a distance under the corona device which is a function of various factors including humidity conditions, copy paper characteristics. The location or position of the given area under the corona device at which this critical charge transfer level is reached may be referred to as the transfer point.

It should be noted that adjacent areas of the sheet along a straight line across the width of the sheet reach their critical point at about the same time due to the geometrical symmetry of the typical transfer corona devices in use. Thus, transfer occurs almost simultaneously along a line across the width of the sheet, the line being located at a distance under the corona device determined by the charge output characteristics of the corona device and various other external conditions, such as humidity, paper characteristics, etc. Since additional paper processing steps (stripping, etc.) immediately follow the transfer station in a xerographic process, it is important that the transfer of toner be fully completed well prior to further processing of the sheet. Since the transfer point or line may vary due to the above noted conditions, it is desirable to have a means for controlling this point as a function of such conditions during the xerographic process and such a means is the specific subject matter of this invention.

Figure 2:
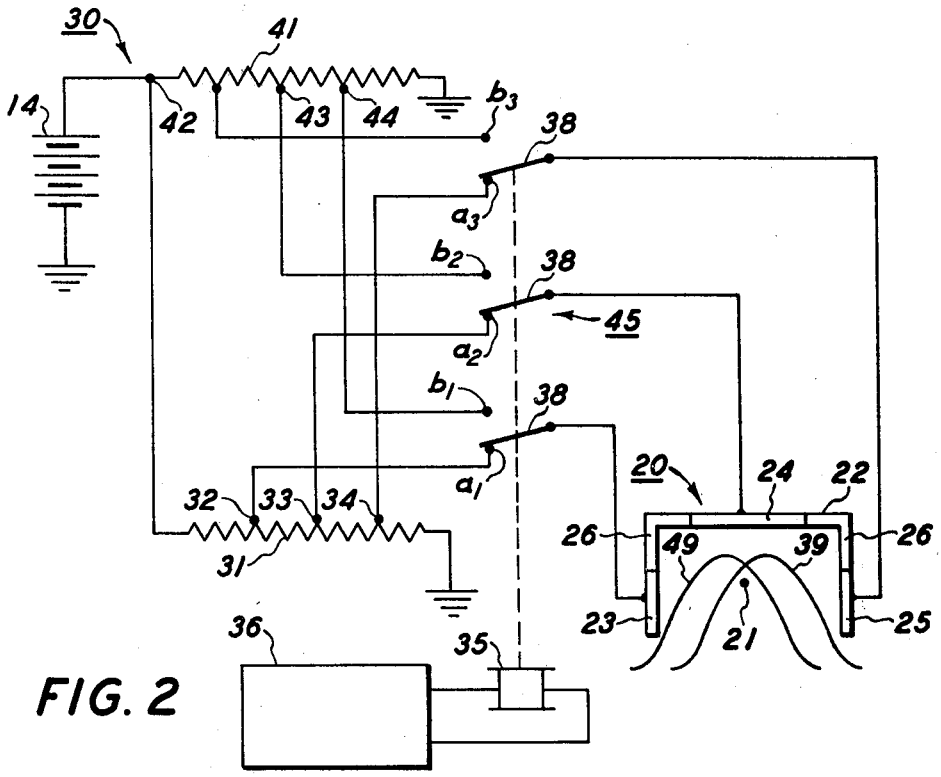
FIG. 2 is a drawing of a corona device according to the invention with a suitable electrical control arrangement for use therewith.

Referring now to FIG. 2 there is shown a corona device 20 according to the invention suitable for use in a transfer station of a xerographic process. The basic structure of a corona device is described in copending application, Ser. No. 553,339, referred to hereinbefore, and comprising an elongated wire 21 partially surrounded by a shield 22, the shield 22 being constructed of a plurality of electrically conducting segments 23–25 insulated from each other by dielectric members 26. The segments 23–25 are generally rectangular in shape and run parallel to the wire 21 across the width of the shield. A greater number of conductive segments may be utilized but only three are shown in FIG. 2 for the sake of clarity.

An electrical biasing arrangement 30 is provided to couple the conductive segments 23–25 to different electrical potentials. The biasing arrangement 30 comprises the variable resistors 31 and 41 each having three taps or voltage pick-off points connected via a switching arrangement 45 to the conductive segments 23–25. Both resistors 31 and 41 are connected between ground or electrical commons and the positive side of a voltage source 11, the negative side of the source 11 also being connected to ground. The corona wire 21 is connected to the positive terminal of the source 11 so that the transfer corona delivers a positive charge to the surface of transfer sheet passing underneath. One skilled in the art is aware that in some xerographic systems the polarities of FIG. 2 would be reversed and such a reversal is well within the teachings of the invention. The magnitude of the voltage source 11 is chosen to provide a corona generating potential difference between the wire 21 and each of the taps on the resistors 31 and 41.

The resistor 31 includes taps 32, 33 and 34, each of which is connected by a conductor to one of the contacts comprising set "*a*" of relay 35, comprising contacts $a_1$, $a_2$, and $a_3$. The resistor 41 likewise includes three taps 42, 43 and 44, which are connected by conductors to a set "*b*" of relay contacts comprising contacts $b_1$, $b_2$, and $b_3$. The relay 35 which includes the contact sets *a* and *b* is coupled to a control circuit 36 whereby upon the occurrence of a preselected condition the relay is energized to engage contacts set *a* or maintained unenergized to engage contact set *b*.

The relay 35 further includes a set of movable arms 38 each of which is electrically connected on one end to one of the conductive segments 23–25 via conductors and connected on its other end to one of the contacts of the sets *a* or *b*.

When contact set *a* is engaged by the movable arms 38, the conductive segments 23, 24 and 25 are coupled respectively via contacts $a_1$, $a_2$ and $a_3$ to the taps 32–34 or resistor 31. In this condition the segment 23 is held at a relatively high potential with respect to the wire 21, segment 24 is held at a potential relatively intermediate, and segment 25 is held at a relatively low potential with respect to the wire 21. It should be noted that the potential source 11 are resistors 31 and 41 are selected such that the potential difference between each of the segments 23–25 and the wire 21, while varying are nevertheless greater than the corona generating potential difference. However, it is equally possible, particularly where a large number of conductive segments are employed to hold some a potentials below corona threshold.

With contacts set *b* engaged the relative potentials of the segments 23 and 25 with respect to the corona wire 21 are reversed. Segment 23 is not connected via contact $b_1$ to the lowest voltage tap 44 on resistor 41, thereby resulting in a relatively high potential difference and a correspondingly strong electric field between this segment and the wire 21. Segment 24 is held at an intermediate potential with respect to the wire via contact $b_2$ while segment 25 is held at a relatively high potential via contact $b_3$ resulting in a relatively low potential difference and a correspondingly weak electric field between segment 25 and wire 21.

As was explained in greater detail in the aforementioned copending application Ser. No. 553,339, in a corona discharge device of the type generally used in xerographic apparatus, the current or charge density in a given area adjacent the wire is a function of the strength of the electric field in this area, a greater charge density occuring in areas having stronger fields.

With this in mind, it is thus seen that with contact set *a* engaged the region under the shield 22 to the right of the wire 21 (between segment 25 and the wire) experiences a relatively strong electric field due to the relatively high potential difference between the wire 21 and segment 25. In an analogous fashion, under these conditions the region under the shield to the left of the wire 21 experiences a relatively weak electric field. This electric field configuration results in a current distribution or ion density function generally shown as curve 39 which indicates that a large current will flow to areas of the copy sheet located under the shield but to the right of the wire (as seen in FIG. 2). Similarly, with contact set *b* engaged, charge or current density will be largest in areas to left of the wire as shown in curve 49 of FIG. 2.

Figure 3:
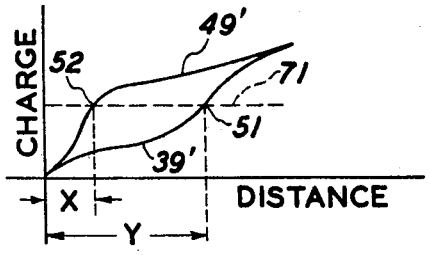
FIG. 3 is an illustrative diagram of the changes in charge on given small area a transfer sheet as a function of distance under the transfer corona device according to the invention.

The increase in charge on a given area of a transfer sheet as a function of distance under the transfer corona devices having charge or current distributions shown in curves 39 and 49 is illustrated by curves 39′ and 49′ of FIG. 3. From these curves it is noted that a transfer corona device having a charge distribution shown in curve 39 results in a charge on a given area which increases as shown in curve 39′. The critical charge level or transfer level at which transfer occurs is shown as line 71 in FIG. 3. Thus, if the corona device operates according to curve 39′ this level is reaches at point 51 and the transfer of toner from a given small area would not take place until it is very nearly out from under the corona device, a distance *y* under the corona device. As opposed to this, it is noted that the transfer level is reached for a given area following curve 49′ at a distance *x* under the corona device (point 52), which is a much smaller distance under the corona device.

It is thus seen that there is provided a means for conveniently changing the transfer area or point in a xerographic process depending upon the condition of the switching arrangement 30.

The condition responsive control 36 may take the form of various humidity or ambient condition sensing circuits generally known in the art. Alternatively, a switch may be provided for manual operation by a machine operator whereby, when a first type of paper is used the switch is operated to a first point to enable a first transfer point, and, when a second type of paper is used, the switch is operated to a second position to enable a second transfer point displaced from the first point.

While the specific embodiment of the invention has been described as being useful as a means for moving the transfer point, it is obvious that an arrangement employing the same principles is equally applicable to holding the transfer point constant during changes of external conditions which would otherwise tend to move the transfer point. Thus, in some situations, it may be desired to maintain the transfer point in an area under the first half of the corona device, such as point 52 in FIG. 3, but due to a change in humidity conditions the transfer point moves nearer to the exit point from the corona device, perhaps point 51 of FIG. 3. Under these circumstances, a biasing arrangement may be activated which would increase the amount of charge deposited in the area of the corona device corresponding to point 52 to thereby return the transfer point to its original position.

It should be noted that the charge deposition characteristics discussed and shown herein, particularly in FIGS. 2 and 3, are not intended to accurately represent the characteristics of any specific corona discharge arrangement. Rather they are "ideal" in nature and are shown and discussed only for the purpose of facilitating an understanding of the principles underlying the invention.

While the embodiments shown are d.c. energized corona devices, the segmented shield arrangement is equally applicable to an a.c. energized corona device.

It is thus seen that a variety of controls are possible within the scope of the invention and it is not intended that the foregoing description of a specific embodiment shall be interpreted as limiting the scope thereof. Other variations, modifications and adaptions will be apparent to those skilled in the art and such as come within the spirit and scope of the appended claims are considered to be embraced by the present invention.

What is claimed is:

1. A corona device including a wire electrode at least partially surrounded by a shield, said shield comprising a plurality of conductive segments insulated from each other, biasing means for providing at least two sets of biasing potentials to said segments and switching means for coupling one of said sets to said segments.

2. The combination recited in claim 1 wherein said switching means includes means responsive to a preselected condition to switch from said one set to another set of potentials.

3. The combination recited in claim 2 wherein said biasing means includes first and second resistor means coupled to said segments through said switching means.

4. In a reproduction process in which toner is transferred from an imaging surface to a transfer member by passing said member under a transfer corona device which imparts to one surface of said member an electrostatic charge to attract the toner from said surface into contact with said member, and wherein toner transfer from a given area of said surface takes place at a transfer area under said device at which a critical charge is accumulated on said surface and wherein said transfer device includes a wire electrode and a shield partially surrounding said electrode, the improvement comprising means for changing the bias applied to said shield in response to a preselected condition to thereby alter the charge distribution from said device and the location of said transfer area.

5. The combination recited in claim 4 wherein said shield comprises a plurality of conductive segments insulated from each other, and said means comprises biasing means for providing biasing potentials to said segments, and means for varying said potentials in response to a preselected condition.

6. The combination recited in claim 5 wherein said segments extend across substantially the entire width of said shield.

7. The combination recited in claim 5 wherein said biasing means applies at least two sets of biasing potentials to said segments and further includes switching means for coupling one or another of said sets to said segments in response to a preselected condition.

8. A method for changing the transfer point at which toner on a given small area of an imaging surface is transferred from said imaging surface to a transfer member by means of a corona discharge device having a discharge electrode and a shield partially surrounding said electrode comprising the steps of electrically biasing said shield to effect a first charge distribution from said device, said first distribution resulting in a first transfer point, and changing said bias on said shield in response to a preselected condition to effect a second charge distribution from said device, said second distribution resulting in a second transfer point.

9. The method recited in claim 8 wherein the step of electrically biasing said shield comprises the steps of constructing said shield of a plurality of conductive segments insulated from each other, and applying a set of potentials to said segments.

10. The method recited in claim 9 wherein the step of changing said bias comprises the steps of connecting each of said segments through a switching means to different potentials and activating said switching means to change the potentials connected to said segments in response to said condition.

* * * * *